US010261454B2

(12) United States Patent
Ooba

(10) Patent No.: US 10,261,454 B2
(45) Date of Patent: Apr. 16, 2019

(54) IMAGE FORMING APPARATUS WITH CREASER CONTROL, CONTROL METHOD THEREOF, PRINTING SYSTEM, AND NON-TRANSITORY COMPUTER-READABLE MEDIUM

(71) Applicant: CANON KABUSHIKI KAISHA, Tokyo (JP)

(72) Inventor: Hideaki Ooba, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/903,056

(22) Filed: Feb. 23, 2018

(65) Prior Publication Data

US 2018/0181043 A1 Jun. 28, 2018

Related U.S. Application Data

(63) Continuation of application No. 15/418,863, filed on Jan. 30, 2017, now Pat. No. 9,946,205, which is a (Continued)

(30) Foreign Application Priority Data

Feb. 25, 2014 (JP) ..... 2014-034708

(51) Int. Cl.
*B65H 43/00* (2006.01)
*G03G 15/00* (2006.01)
(Continued)

(52) U.S. Cl.
CPC ..... *G03G 15/5016* (2013.01); *B42C 7/005* (2013.01); *B42C 13/003* (2013.01); (Continued)

(58) Field of Classification Search
CPC ..... B42C 19/00; B42C 13/003; B42C 7/005; G03G 15/6544; G03G 15/6582; B65H 43/00; B65H 37/06; B65G 45/30
(Continued)

(56) References Cited

U.S. PATENT DOCUMENTS 6,364,590 B1 4/2002 Gayoso
8,316,749 B2 11/2012 Rimai et al.
(Continued)

FOREIGN PATENT DOCUMENTS

JP 2008-127107 A 6/2008
JP 2012-041187 A 3/2012
JP 2013-119451 A 6/2013

OTHER PUBLICATIONS

U.S. Appl. No. 14/632,235, filed Feb. 26, 2015.
(Continued)

*Primary Examiner* — Patrick H MacKey
(74) *Attorney, Agent, or Firm* — Venable LLP

(57) ABSTRACT

An image forming apparatus determines whether crease processing at a plurality of portions set on the sheet includes crease processing on two, front and back surfaces of the sheet; determines, if it is determined that crease processing includes crease processing on the two surfaces of the sheet, whether a connected post-processing apparatus that performs crease processing on a sheet can perform crease processing on the two, front and back surfaces of the sheet by one feeding; and controls, if it is determined that the connected post-processing apparatus cannot perform crease processing on the two surfaces by one feeding, to change, to one of the front and back surfaces of the sheet based on attribute information of the sheet, a surface to be processed in crease processing at the plurality of portions.

4 Claims, 15 Drawing Sheets

Related U.S. Application Data continuation of application No. 14/614,788, filed on Feb. 5, 2015, now Pat. No. 9,598,260.

(51) Int. Cl.

| | |
|---|---|
| ***B65H 37/06*** | (2006.01) |
| ***B65H 45/30*** | (2006.01) |
| ***B42C 7/00*** | (2006.01) |
| ***B42C 13/00*** | (2006.01) |

(52) U.S. Cl.

CPC ..... *B65H 37/06* (2013.01); *B65H 43/00* (2013.01); *B65H 45/30* (2013.01); *G03G 15/6582* (2013.01); *B65H 2301/132* (2013.01); *B65H 2301/17* (2013.01); *B65H 2511/13* (2013.01); *B65H 2511/216* (2013.01); *B65H 2511/414* (2013.01); *B65H 2515/112* (2013.01); *B65H 2551/20* (2013.01); *B65H 2801/27* (2013.01); *G03G 2215/00021* (2013.01); *G03G 2215/00877* (2013.01)

(58) Field of Classification Search

USPC ..... 270/52.18, 58.08; 412/3, 4, 5, 17, 18, 412/21, 22

See application file for complete search history.

(56) References Cited

U.S. PATENT DOCUMENTS

| | | | | |
|---|---|---|---|---|
| 8,528,891 | B2 | 9/2013 | Aiba et al. | |
| 9,365,069 | B2 | 6/2016 | Kawai | |
| 9,598,260 | B2 * | 3/2017 | Ooba | B65H 43/00 |
| 9,946,205 | B2 * | 4/2018 | Ooba | B65H 43/00 |
| 2009/0291814 | A1 | 11/2009 | Garner et al. | |
| 2012/0021884 | A1 | 1/2012 | Musha | |
| 2012/0086161 | A1 | 4/2012 | Nagasako et al. | |
| 2015/0063952 | A1 | 3/2015 | Kawai | |
| 2015/0158322 | A1 | 6/2015 | Kato | |
| 2015/0239276 | A1 | 8/2015 | Sakata | |
| 2016/0090265 | A1 | 3/2016 | Tsutsumi et al. | |

OTHER PUBLICATIONS

U.S. Appl. No. 14/632,367, filed Feb. 26, 2015.

Office Action dated Oct. 20, 2017, in Japanese Patent Application No. 2014-034708.

* cited by examiner

FIG. 8

| GRAMMAGE | VALLEY FOLD |
|---|---|
| < 150 gsm | OK |
| ≥ 150 gsm | NG |

IMAGE FORMING APPARATUS WITH CREASER CONTROL, CONTROL METHOD THEREOF, PRINTING SYSTEM, AND NON-TRANSITORY COMPUTER-READABLE MEDIUM

This is a continuation of U.S. patent application Ser. No. 15/418,863, filed Jan. 30, 2017, which is a continuation of U.S. patent application Ser. No. 14/614,788, filed Feb. 5, 2015, now U.S. Pat. No. 9,598,260.

BACKGROUND OF THE INVENTION

Field of the Invention

The present invention relates to an image forming apparatus, a control method thereof, a printing system, and a non-transitory computer-readable medium and, more particularly, to control when a post-processing apparatus configured to perform crease processing is connected to an image forming apparatus.

Description of the Related Art

On the printing market, various output materials are created using post-processing apparatuses for sheets having undergone image formation by an image forming apparatus. For example, there is a saddle stitching machine aiming to create (saddle-stitch) a simple booklet by folding an output sheet bundle into two at the center and stapling the fold. There is also a sheet folding apparatus aiming to divide an output sheet into three panels, fold one panel inside, and fold (C-fold) one panel on the opposite side to overlap that panel so as to be able to easily insert the sheet into an envelope or the like.

When the above-mentioned folding is executed, a force that stretches an outer sheet against the folding direction acts to crack the crease (to be referred to as a crack of the spine hereinafter), and the spine is visible as a white color. If this portion has a pattern (for example, an image) or a character, the appearance is greatly degraded. To prevent this, a crease processing for making a crease at a fold in advance is known so as to easily fold an outer sheet and not to generate a crack in the spine. A post-processing apparatus that performs crease processing is an apparatus called a creaser.

Types of folding methods can be classified into "mountain fold" and "valley fold" in accordance with a direction in which a sheet is folded after crease processing. The mountain fold is a method of folding, into a mountain shape, a surface against which the creasing blade of a creasing mechanism is pressed. The valley fold is a method of folding, into a valley shape, a surface against which the creasing blade is pressed. Although both the mountain fold and valley fold are effective for preventing a crack of the spine, and either fold method is usable, the mountain fold is generally used. The valley fold is used when it is superior to the mountain fold in terms of the type of sheet to be used, the folding position, the appearance, and the like. There has already been known an image forming system that automatically switches between the mountain fold and the valley fold by using sheet information and bookbinding information.

For example, in Japanese Patent Laid-Open No. 2012-41187, the settings (for example, monochrome, bookbinding designation, bookbinding cover, and medium information) of an output material are obtained from sheet information and bookbinding information, either of the mountain fold and valley fold is decided, and crease processing is executed on a necessary surface. When an image is printed at the crease portion and a crack of the spine is readily generated, crease processing is performed to make a mountain fold. When a crack of the spine is hardly generated, crease processing is performed to make a valley fold.

However, in Japanese Patent Laid-Open No. 2012-41187, when crease processing is performed a plurality of times (at a plurality of portions) on one sheet in order to execute crease processing on a necessary surface in accordance with settings (for example, Z-folding, C-folding, or bookbinding cover), execution of crease processing on two, front and back surfaces is not considered. In the case of such designation, a post-processing apparatus capable of simultaneously executing crease processing on the front and back surfaces can execute crease processing at once by one feeding operation. However, a post-processing apparatus capable of executing crease processing on only either the front or back surface by one feeding operation needs to perform feeding twice to the creasing apparatus for one sheet for which crease processing is set for the two, front and back surfaces. If feeding is performed twice, the procedures and time until a desired printed material is obtained are increased. Since the feeding work is performed a plurality of times, the load on a sheet is also increased, putting an excessive load on the output material.

SUMMARY OF THE INVENTION

According to one aspect of the present invention, there is provided an image forming apparatus which is able to connect with a post-processing apparatus configured to perform crease processing on a sheet, comprising: a crease processing determination unit configured to determine whether crease processing at a plurality of portions set on the sheet includes crease processing on two (front and back) surfaces of the sheet; a function determination unit configured to, if the crease processing determination unit determines that crease processing includes crease processing on the two surfaces of the sheet, determine whether the connected post-processing apparatus can perform crease processing on the two (front and back) surfaces of the sheet by one feeding; and a control unit configured to, if the function determination unit determines that the connected post-processing apparatus cannot perform crease processing on the two surfaces by one feeding, control to change, to one of the front and back surfaces of the sheet based on attribute information of the sheet, a surface to be processed in crease processing at the plurality of portions.

According to another aspect of the present invention, there is provided a printing system comprising an image forming apparatus, and a post-processing apparatus connected to the image forming apparatus and configured to perform crease processing on a sheet, the image forming apparatus comprising: a crease processing determination unit configured to determine whether crease processing at a plurality of portions set on the sheet includes crease processing on two (front and back) surfaces of the sheet; a function determination unit configured to, if the crease processing determination unit determines that crease processing includes crease processing on the two surfaces of the sheet, determine whether the connected post-processing apparatus can perform crease processing on the two (front and back) surfaces of the sheet by one feeding; and a control unit configured to, if the function determination unit determines that the connected post-processing apparatus cannot perform crease processing on the two surfaces by one feeding, control to change, to one of the front and back surfaces of the sheet based on attribute information of the sheet, a surface to be processed in crease processing at the plurality of portions.

According to another aspect of the present invention, there is provided a method of controlling an image forming apparatus which is able to connect with a post-processing apparatus configured to perform crease processing on a sheet, comprising: determining whether crease processing at a plurality of portions set on the sheet includes crease processing on two (front and back) surfaces of the sheet; determining, if crease processing is determined to include crease processing on the two surfaces of the sheet, whether the connected post-processing apparatus can perform crease processing on the two (front and back) surfaces of the sheet by one feeding; and controlling, if the connected post-processing apparatus is determined to be unable to perform crease processing on the two surfaces by one feeding, to change, to one of the front and back surfaces of the sheet based on attribute information of the sheet, a surface to be processed in crease processing at the plurality of portions.

According to another aspect of the present invention, there is provided a non-transitory computer-readable medium storing a program for causing a computer of an image forming apparatus which is able to connect with a post-processing apparatus configured to perform crease processing on a sheet, to function as: a crease processing determination unit configured to determine whether crease processing at a plurality of portions set on the sheet includes crease processing on two (front and back) surfaces of the sheet; a function determination unit configured to, if the crease processing determination unit determines that crease processing includes crease processing on the two surfaces of the sheet, determine whether the connected post-processing apparatus can perform crease processing on the two (front and back) surfaces of the sheet by one feeding; and a control unit configured to, if the function determination unit determines that the connected post-processing apparatus cannot perform crease processing on the two surfaces by one feeding, control to change, to one of the front and back surfaces of the sheet based on attribute information of the sheet, a surface to be processed in crease processing at the plurality of portions.

The present invention can reduce the procedures and time until a printed material, for which crease processing is set as post-processing, is obtained, and reduce the work load on the user for the printed material.

Further features of the present invention will become apparent from the following description of exemplary embodiments (with reference to the attached drawings).

BRIEF DESCRIPTION OF THE DRAWINGS

FIG. 8 is a table showing an example of the arrangement of a determination table for determining a folding direction;

DESCRIPTION OF THE EMBODIMENTS

Embodiments of the present invention will now be described with reference to the accompanying drawings.

[System Arrangement]

An overall system including a post-processing apparatus that practices the present invention will be explained with reference to FIGS. 2A, 2B, and 3.

Figure 2A:
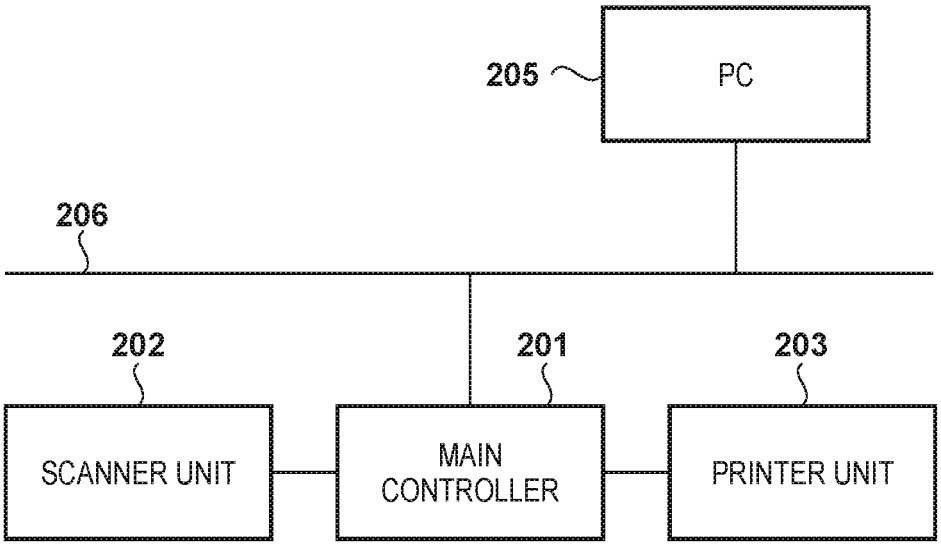
FIGS. 2A and 2B are block diagrams showing an example of the arrangement of an overall system.

In FIG. 2A, a main controller 201 that mainly performs job scheduling control, a scanner unit 202 that scans a paper document, and a printer unit 203 that prints an image are connected. The main controller 201, the scanner unit 202, and the printer unit 203 constitute a printing system. The detailed connection form of the main controller 201, scanner unit 202, and printer unit 203 will be explained with reference to FIG. 4. The printer unit 203 will be explained in detail with reference to FIG. 3.

The main controller 201 is further connected to a PC 205 via a network 206. The PC 205 inputs a job to the main controller 201 by using a printer driver or the like.

Figure 2B:
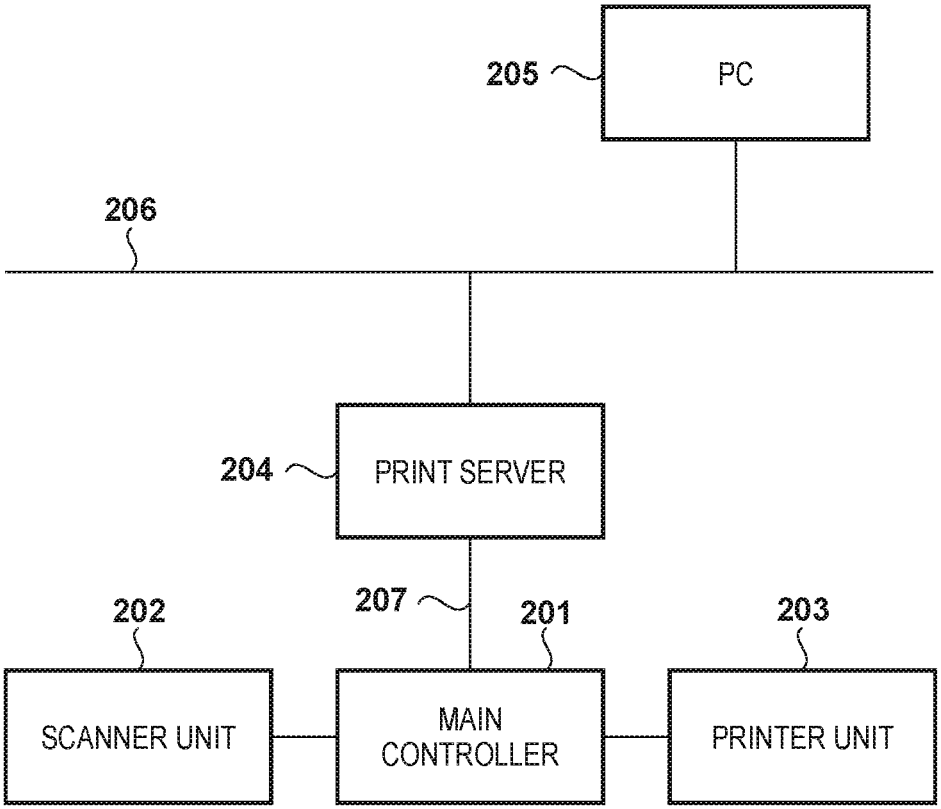

As another example of the system arrangement, the system may be constituted as shown in FIG. 2B. The system in FIG. 2B is different from that in FIG. 2A in that a print server 204 is connected between the main controller 201 and the network 206. The print server 204 temporarily receives a print job input from the PC 205 connected to the network 206, and performs image processing and the like. After the end of these processes, the print server 204 inputs the job to the main controller 201 via a local network 207.

As for input of a job from the print server 204, a job may be input to the main controller 201 after the end of image processing and the like without a user instruction. Alternatively, the system may be configured to temporarily save a job in the print server 204 after the end of image processing and the like, and allow the user to instruct the main controller 201 to input the job at a timing when the user wants to print. In this case, the main controller 201, the scanner unit 202, the printer unit 203, and the print server 204 are recognized altogether as one printing system when viewed from an apparatus on the external network side.

Figure 3:
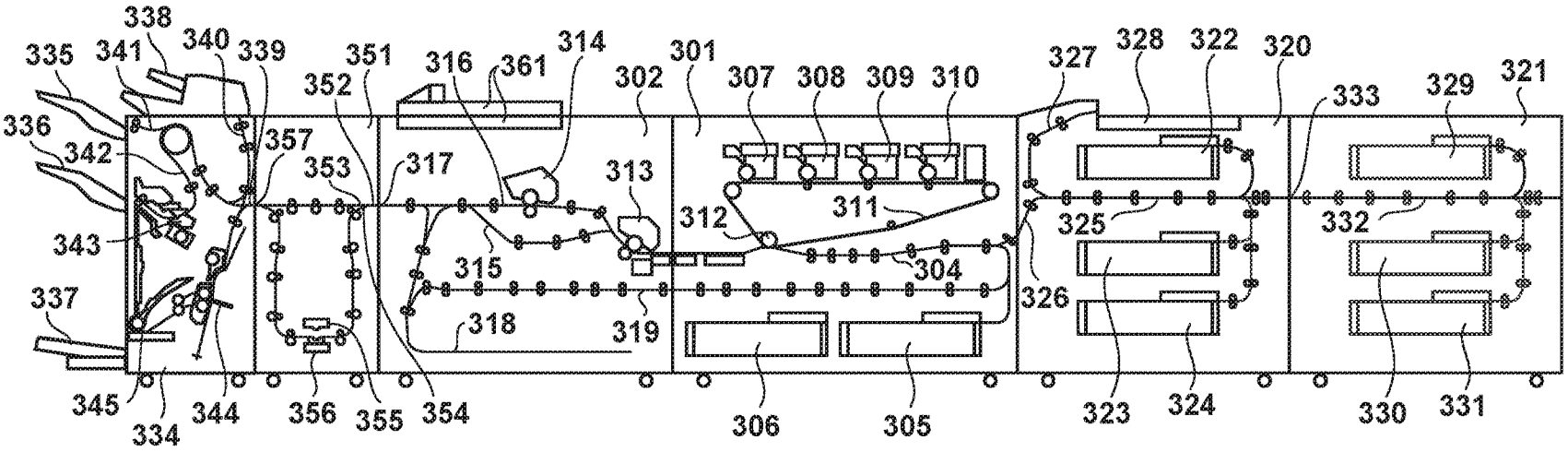
FIG. 3 is a view for explaining the arrangement of an overall printing system including a creaser.

FIG. 3 shows an overall printing system including an image forming apparatus, a feeding apparatus, and a post-processing apparatus. A part that performs a main image forming operation is constituted by an image forming apparatus 301 and an image fixing apparatus 302. The image forming apparatus 301 and the image fixing apparatus 302 form an image on a sheet. In FIG. 3, a large-volume feeding deck 320 is connected as a feeding apparatus on the right side of the image forming apparatus 301. A plurality of feeding decks are connectable, and a large-volume feeding deck 321 is further connected on the right side of the large-volume feeding deck 320. Furthermore, in FIG. 3, a creaser 351 is connected as a post-processing apparatus on the left side of the image fixing apparatus 302. The creaser 351 is a post-processing machine that makes a crease in advance at a portion where a sheet is folded. Control of a most characteristic post-processing apparatus in the present invention will be explained by exemplifying control of the creaser 351. In FIG. 3, a finisher 334 is connected as a post-processing apparatus on the left side of the creaser 351.

Feeding decks 305 and 306 are arranged in the image forming apparatus 301 and operate as standard feeding units. To form a color image, developing units 307 to 310 are arranged as four Y, M, C, and K stations. A formed image is primarily transferred to an intermediate transfer belt 311. The intermediate transfer belt 311 rotates clockwise in FIG. 3, and the image is transferred to a sheet conveyed from a sheet conveyance path 304 at a secondary transfer position 312. After the sheet is delivered from the image forming apparatus 301 to the image fixing apparatus 302, the image transferred to the sheet is heated and pressed by a fixing unit 313 in the image fixing apparatus 302, thereby fixing the image to the sheet. The sheet having passed through the fixing unit 313 passes through a conveyance path 315 and is conveyed to a connection portion 317 with a creaser 351. When additional heating/pressing is necessary for fixing depending on the type of sheet or the like, the sheet passes through the fixing unit 313, is conveyed to a second fixing unit 314 by using an upper conveyance path, and additionally heated/pressed. After that, the sheet passes through a conveyance path 316 and is conveyed to the connection portion 317. When the image forming mode is a double-sided mode, the sheet is conveyed to a sheet reversing path 318, reversed on the sheet reversing path 318, conveyed to a sheet conveyance path 319, and fed again to the image forming apparatus 301. The image forming apparatus 301 then performs image formation on the second one of the two surfaces.

Sheets can also be fed from three feeding decks 322, 323, and 324 of the large-volume feeding deck 320, in addition to the standard feeding units (in this case, the feeding decks 305 and 306) of the image forming apparatus 301. A fed sheet is conveyed through sheet conveyance paths 325 and 326, supplied to the image forming apparatus 301, and undergoes image formation. When the further large-volume feeding deck 321 is connected, sheets can also be fed from three feeding decks 329, 330, and 331. A sheet conveyed through a sheet conveyance path 332 is delivered to the large-volume feeding deck 320 at a connection portion 333. These large-volume feeding decks have a function of detecting double feed in which a plurality of sheets are conveyed while overlapping each other. When double feeding is detected, the sheet conveyance path is switched from the normal conveyance path 326 to a conveyance path 327, and the overlapping sheets are discharged to an escape tray 328.

The creaser 351 of the post-processing apparatus will be explained next. The creaser 351 is a post-processing apparatus that makes a crease at a predetermined position of a sheet. A sheet having undergone image formation is conveyed from the image fixing apparatus 302 to the sheet conveyance portion of the creaser 351 through the connection portion 317. When the conveyed sheet has a crease designation, the sheet passes through a sheet conveyance path 354 from a sheet conveyance path 352, is sandwiched between a male creasing die 355 and a female creasing die 356, and is creased. That is, the creasing dies 355 and 356 constitute a creasing mechanism. At this time, the creasing dies 355 and 356 can be changed depending on the grammage and type of sheet, and the user sets appropriate dies every time a sheet is creased. After the end of crease processing, the sheet passes through a connection portion 357 with the finisher 334 serving as another post-processing apparatus, and is unloaded to the finisher 334. When a sheet does not have crease designation, it is unloaded to the connection portion 357 from the sheet conveyance path 352 through a sheet conveyance path 353.

The finisher 334 will be described next. The finisher 334 adds post-processing to a printed sheet in accordance with a function designated by the user. More specifically, the finisher 334 has functions such as stapling (single/double stitching), punching (two holes/three holes), and saddle stitching. The finisher 334 includes two discharge trays 335 and 336, and a sheet is output to the discharge tray 335 through a sheet conveyance path 341. The sheet conveyance path 341 cannot perform processing such as stapling. When performing processing such as stapling, a sheet undergoes finishing of a function designated by the user by a processing unit 343 through a sheet conveyance path 342, and is output to the discharge tray 336. The discharge trays 335 and 336 can be moved up and down. The discharge tray 335 can also be operated to be moved down and stack, from a lower discharge port, a sheet having undergone finishing processing by the processing unit 343.

When an insertion sheet is designated by user designation, the finisher 334 can also be operated to insert, into a predetermined page through a sheet conveyance path 340, an insertion sheet set on an inserter 338. When saddle stitching is designated, a saddle stitching unit 344 staples sheets at the center, folds them into two, and outputs them to a saddle stitching tray 337 through a sheet conveyance path 345. The saddle stitching tray 337 is constituted by a belt conveyor. A saddle-stitched bundle stacked on the saddle stitching tray 337 is conveyed to a further left position in the printing system.

The scanner and the document feeder will be explained. The scanner is used mainly for the copy function. When setting a document on the document table and reading it, the user sets the document on the document table and closes a document feeder. After an opening/closing sensor (not shown) detects that the document table has been closed, a reflection document size detection sensor (not shown) in the housing of the scanner detects the size of the set document. The scanner irradiates the document with a light source in response to the size detection, and a CCD (not shown) reads an image and converts it into a digital signal. The digital signal undergoes desired image processing and is converted into a laser recording signal. The converted recording signal is stored in the internal memory of a controller to be described with reference to FIG. 4.

When setting a document on the document feeder and reading it, the user sets the document on the document setting portion (not shown) of the document feeder with the document facing up. Then, a document presence/absence sensor (not shown) detects that the document has been set. In response to this, a document feed roller (not shown) and a conveyor belt (not shown) rotate to convey the document and set it at a predetermined position on the document table. After that, an image is read similarly to reading on the document table, and the read image is stored in the internal memory of the controller.

[Hardware Arrangement]

Figure 4:
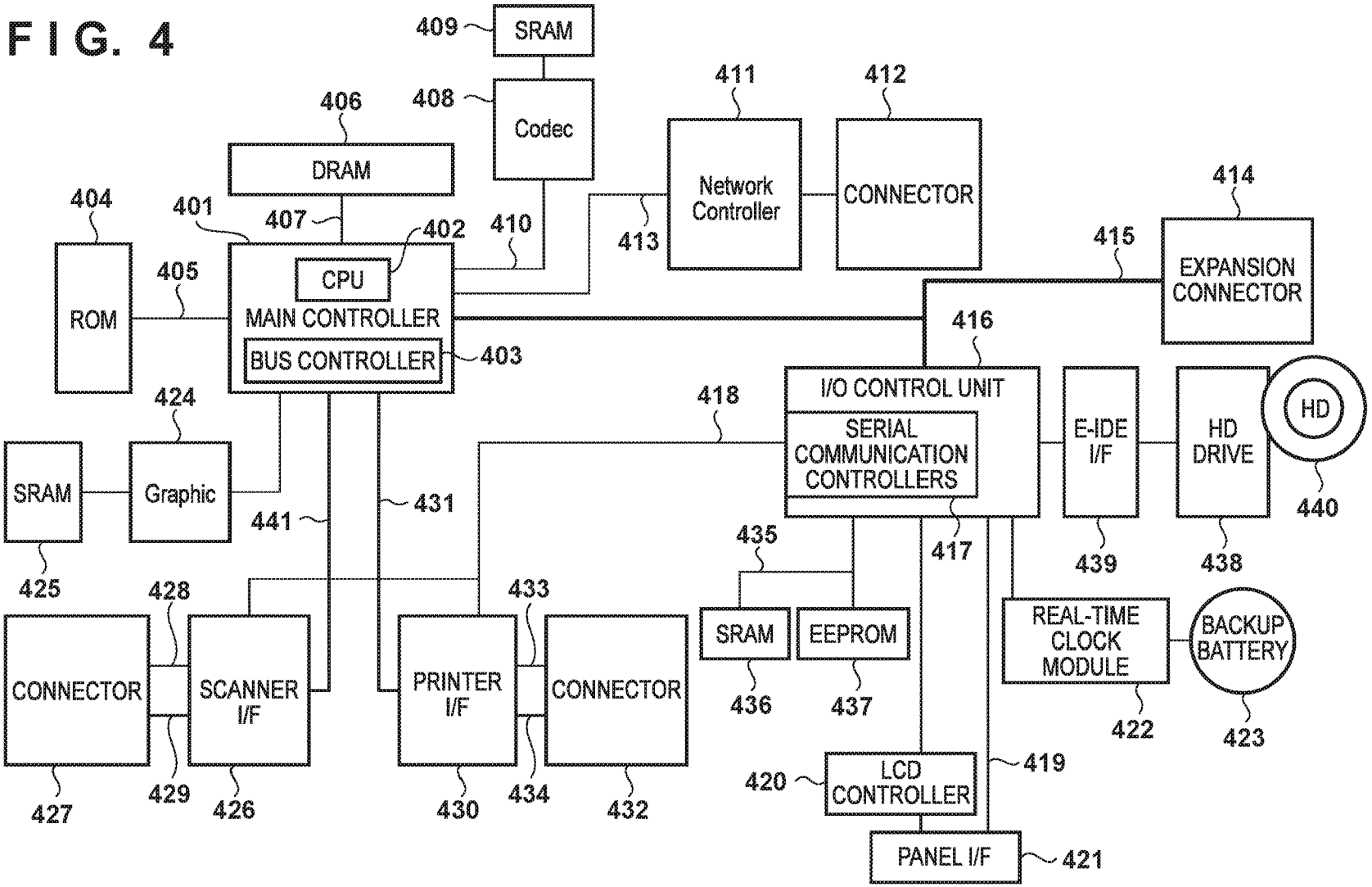
FIG. 4 is a block diagram showing an example of the hardware arrangements of a main controller and its peripheral units.

An example of the hardware arrangements of the controller that controls the image forming apparatus, and the peripheral units of the controller will be explained with reference to FIG. 4. A main controller 401 mainly includes a CPU 402, a bus controller 403, and various I/F controller circuits.

The CPU 402 and the bus controller 403 control the operation of the overall apparatus. The CPU 402 operates based on a program loaded from a ROM 404 via a ROM I/F 405. The CPU 402 interprets PDL (Page Description Language) code data received from the PC 205. This program also describes an operation of rasterizing data into raster image data, and is processed by software. The bus controller 403 controls transfer of data input/output from/to each I/F, and performs bus arbitration and DMA data transfer control.

A DRAM 406 is connected to the main controller 401 by a DRAM I/F 407, and is used as a work area by the CPU 402 to operate and an area for accumulating image data. A Codec 408 compresses raster image data accumulated in the DRAM 406 according to a method such as MH/MR/MMR/JBIG/JPEG, and decompresses compressed/accumulated code data into raster image data. An SRAM 409 is used as a temporary work area for the Codec 408. The Codec 408 is connected to the main controller 401 via an I/F 410, and the bus controller 403 controls data transfer between the Codec 408 and the DRAM 406 by DMA.

A graphic processor 424 performs processes such as image rotation, image scaling, color space conversion, and binarization for raster image data accumulated in the DRAM 406. An SRAM 425 is used as a temporary work area for the graphic processor 424. The graphic processor 424 is connected to the main controller 401 via an I/F, and the bus controller 403 controls data transfer between the graphic processor 424 and the DRAM 406 by DMA.

A network controller 411 is connected to the main controller 401 via an I/F 413 and to an external network via a connector 412. A general example of the network is Ethernet®. An expansion connector 414 for connecting an expansion board (not shown), and an I/O control unit 416 are connected to a general-purpose high-speed bus 415. A general example of the general-purpose high-speed bus is a PCI bus. The I/O control unit 416 includes serial communication controllers 417 of two channels for sending/receiving control commands to/from the respective CPUs of the scanner unit 202 and printer unit 203. The serial communication controllers 417 are connected to a scanner I/F 426 and a printer I/F 430 via an I/O bus 418.

A panel I/F 421 is connected to an LCD controller 420, and includes an I/F for presenting a display on a liquid crystal screen on an operation unit, and a key input I/F for accepting inputs from hard keys and touch panel keys.

Figure 5:
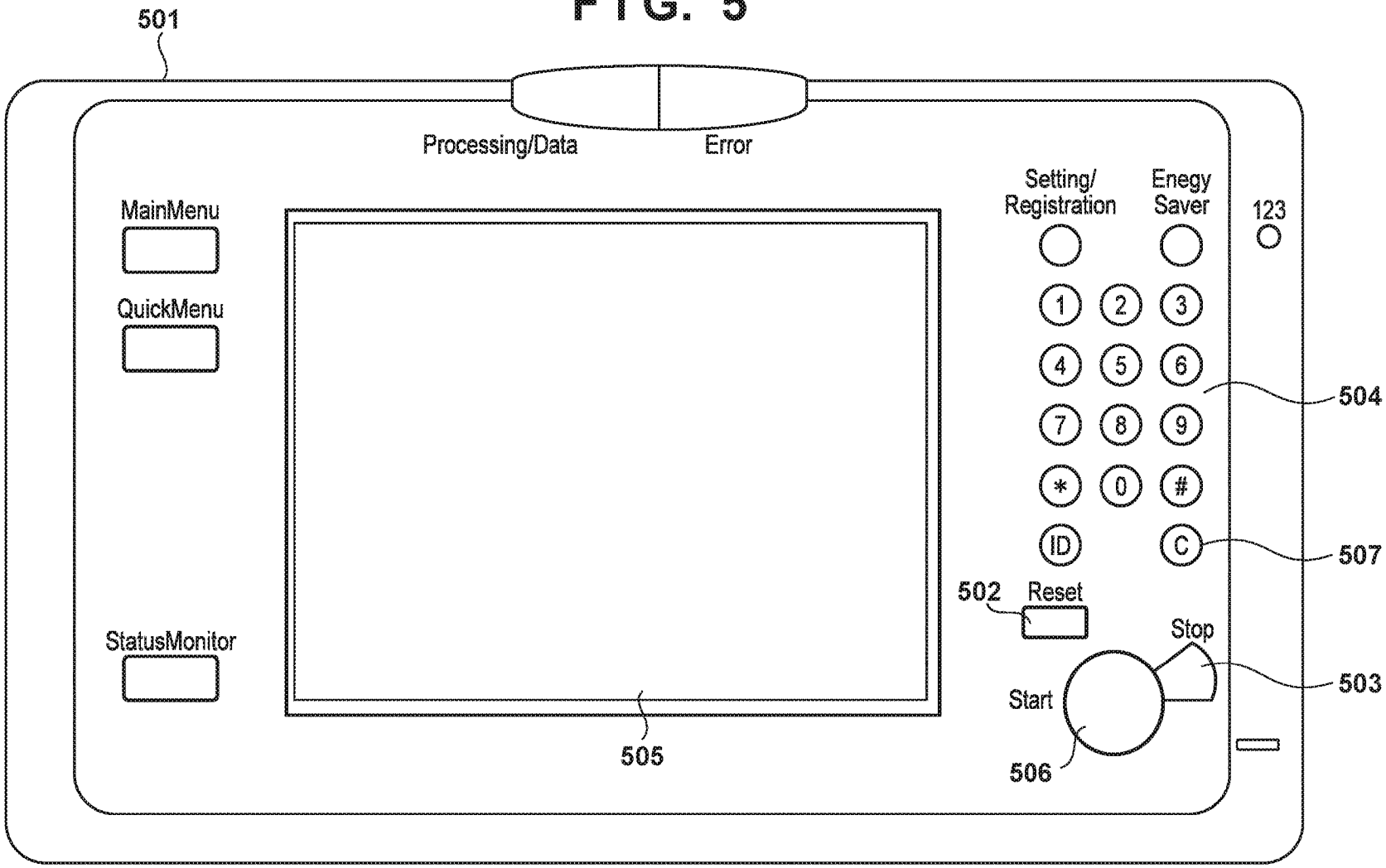
FIG. 5 is a view showing an example of the arrangement of an operation panel.

FIG. 5 shows an example of the operation unit connected to the panel I/F 421. An operation unit 501 includes a liquid crystal display unit, a touch panel input device adhered onto the liquid crystal display unit, and a plurality of hard keys. A signal input from the touch panel or the hard key is transferred to the CPU 402 via the panel I/F 421. The liquid crystal display unit displays image data sent from the panel I/F 421. The liquid crystal display unit displays functions, image data, and the like in the operation of the printing system, details of which will be described later.

A real-time clock module 422 updates/saves the date and time managed in the device, and is backed up by a backup battery 423. An E-IDE interface 439 is an I/F that connects an external storage device. In this embodiment, a hard disk drive 438 is connected via the I/F to store image data in a hard disk 440 and read out image data from the hard disk 440. Connectors 427 and 432 are connected the scanner unit 202 and the printer unit 203, respectively, and include asynchronous serial I/Fs 428 and 433 and video I/Fs 429 and 434, respectively.

The scanner I/F 426 is connected to the scanner unit 202 via the connector 427 and to the main controller 401 via a scanner bus 441. The scanner I/F 426 has a function of performing predetermined processing on an image received from the scanner unit 202, and also has a function of outputting, to the video I/F 429, a control signal generated based on a video control signal sent from the scanner unit 202. The bus controller 403 controls data transfer from the video I/F 429 to the DRAM 406.

The printer I/F 430 is connected to the printer unit 203 via the connector 432 and to the main controller 401 via a printer bus 431. The printer I/F 430 has a function of performing predetermined processing on image data output from the main controller 401 and outputting the processed image data to the printer unit 203. Further, the printer I/F 430 has a function of outputting, to the printer bus 431, a control signal generated based on a video control signal sent from the printer unit 203. The bus controller 403 controls a transfer of raster image data rasterized on the DRAM 406 to the printer unit 203, and transfers the raster image data to the printer unit 203 via the printer bus 431 and the video I/F 434 by DMA.

An SRAM 436 is a memory capable of holding storage contents by power supplied from the backup battery even when the whole apparatus is turned off. The SRAM 436 is connected to the I/O control unit 416 via a bus 435. An EEPROM 437 is similarly connected to the I/O control unit 416 via the bus 435.

[Operation Unit]

The operation unit for making various settings will be explained next. An operation unit 501 shown in FIG. 5 is connected to the panel I/F 421 in FIG. 4. A reset key 502 is a key for canceling values and the like set by the user. A stop key 503 is a key for stopping a running job. A ten-key pad 504 includes keys for inputting a numerical value such as an entry. An operation screen 505 is a touch panel operation screen. A start key 506 is a key for starting a job such as reading of a document. A clear key 507 is a key for clearing settings and the like. The operation unit 501 includes an initial setting/registration button, a button for saving power, a button for displaying a main menu, a quick menu button which constitutes a customized window for each user, and a status monitor button for displaying a device status.

[Folding Method]

Figure 6A:
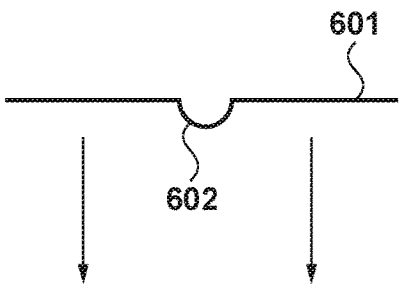
FIGS. 6A, 6B, 6C, and 6D are views for explaining a folding direction at the time of creasing.
Figure 6C:
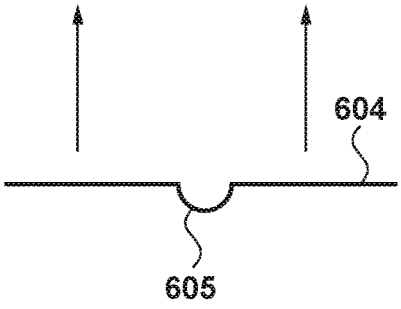
Figure 6B:
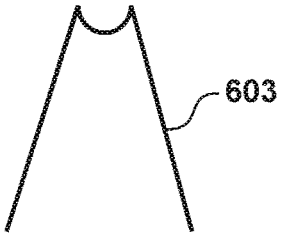
Figure 6D:
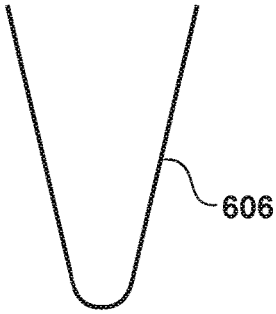

A folding method after crease processing will be explained with reference to FIGS. 6A to 6D. There are two, mountain and valley folding methods in accordance with the folding direction after executing crease processing. The mountain fold is a method of folding, into a mountain shape, a side (surface) against which the creasing die 355 is pressed. In FIG. 6A, 601 represents the state of a sheet after crease processing, and 602 represents a state in which crease processing has been performed using the creasing dies 355 and 356. In FIG. 6B, 603 represents a state in which the sheet has been mountain-folded. The valley fold is a method of folding, into a valley shape, a side against which the creasing die 355 is pressed. In FIG. 6C, 604 represents the state of a sheet after crease processing, and 605 represents a state in which crease processing has been performed using the creasing dies 355 and 356. In FIG. 6D, 606 represents a state in which the sheet has been valley-folded.

[Processing of Restricting Crease Surface on Job Receiving Side]

A sequence when executing crease processing in the printing system will be explained with reference to FIG. 7. Note that the flowchart shown in FIG. 7 is implemented by reading out a program stored in the ROM 404 or the like and executing it by the CPU 402.

Figure 1A:
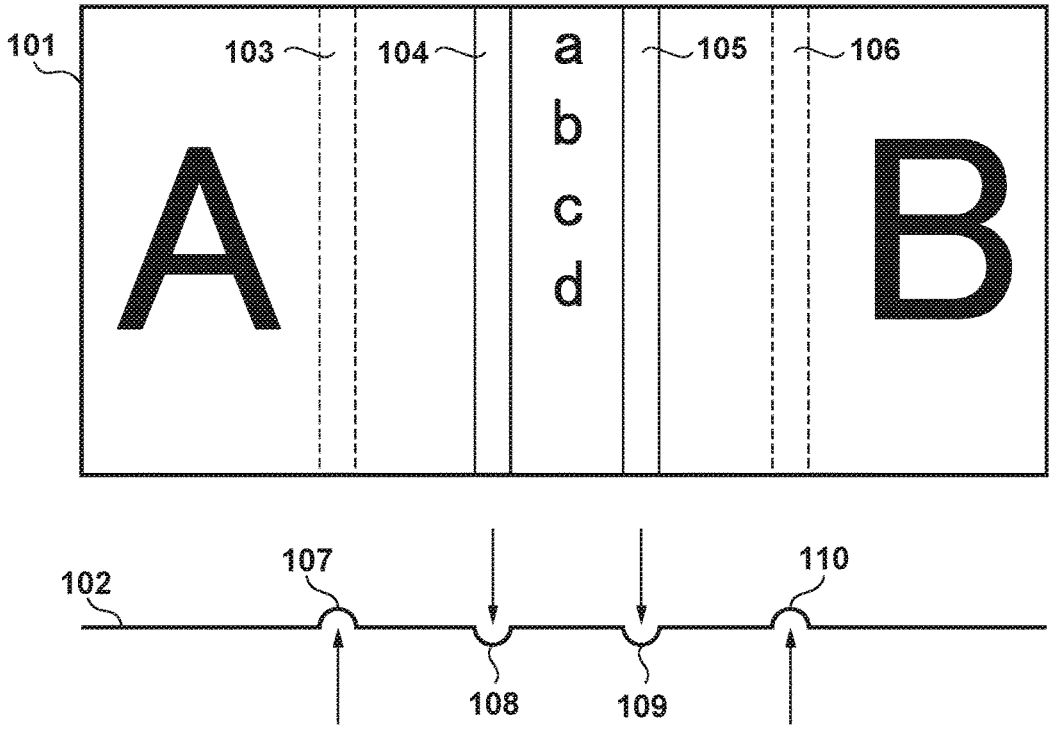
FIGS. 1A and 1B are views for explaining crease processing on two surfaces and crease processing on one surface.
Figure 1B:
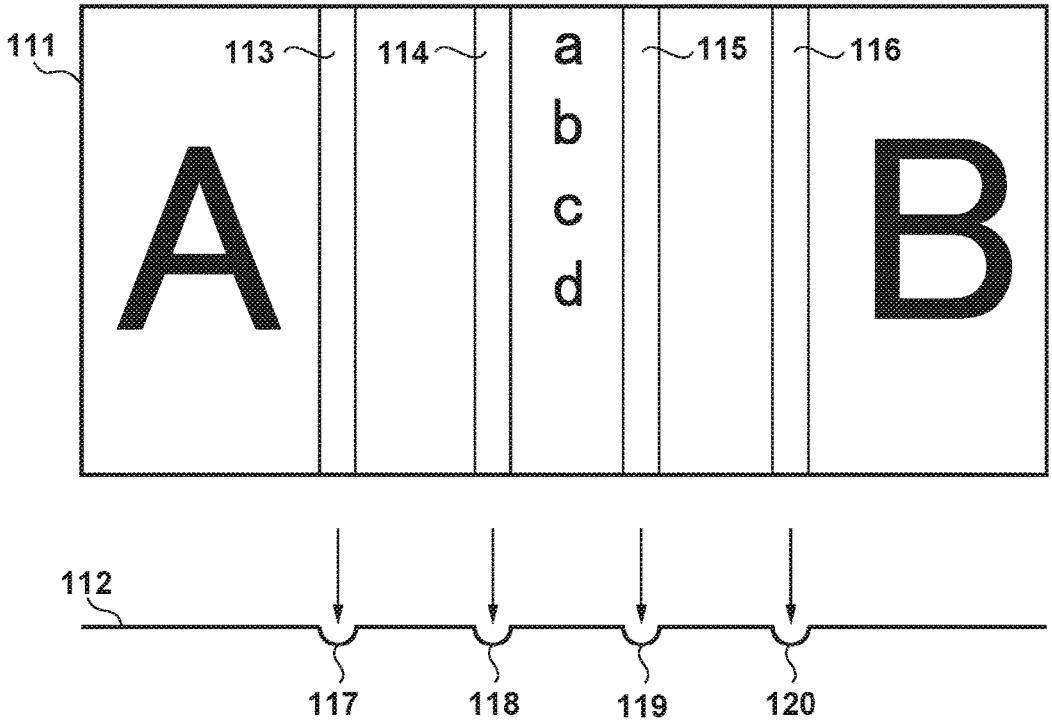
Figure 7:
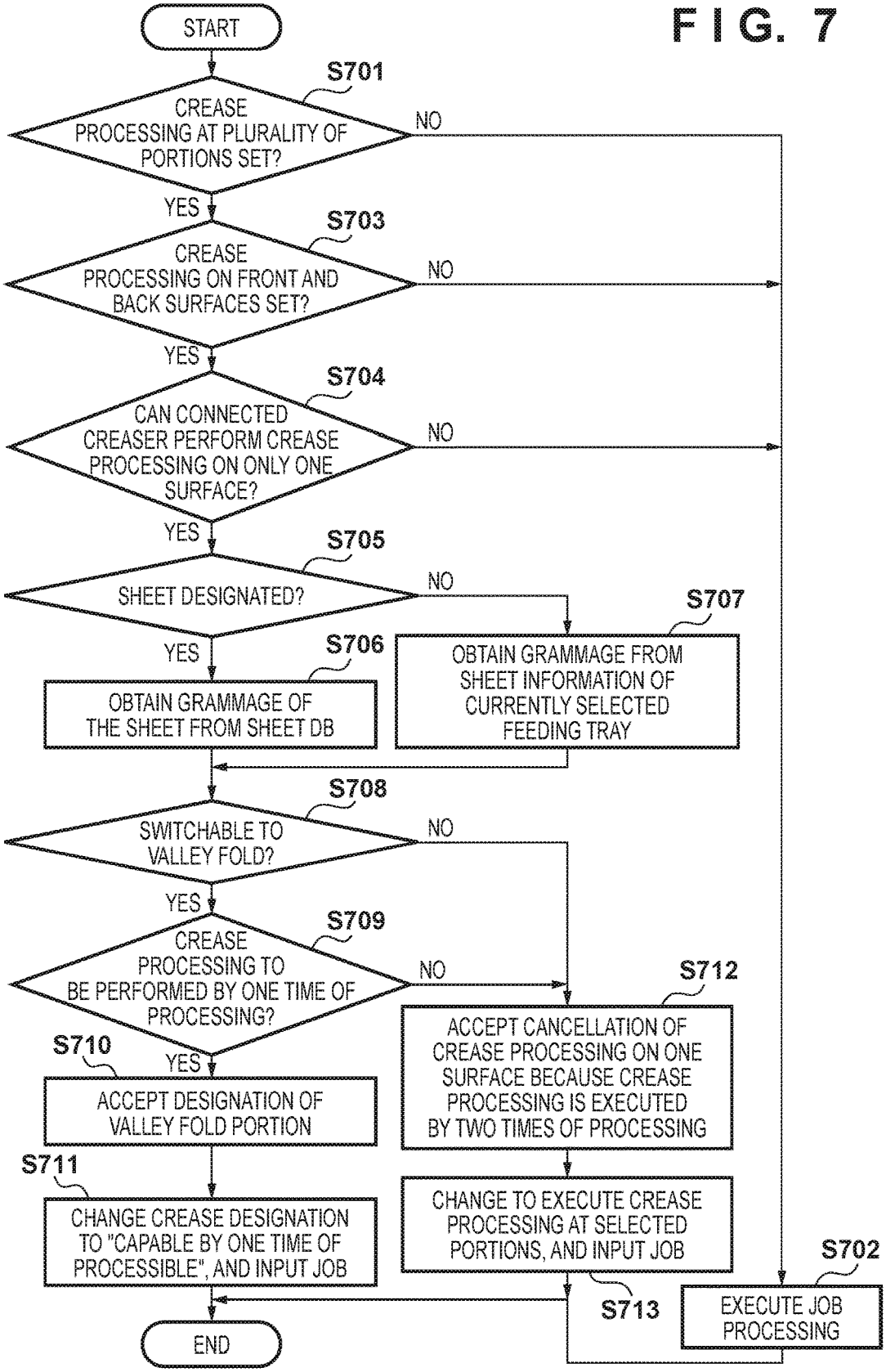
FIG. 7 is a flowchart showing crease processing in an image forming apparatus.

Upon receiving a print job, the CPU 402 starts processing shown in FIG. 7. This embodiment assumes a case in which a print job including a bookbinding cover as shown in FIG. 1A is processed. First, crease processing on a sheet surface will be explained with reference to FIGS. 1A and 1B. A sheet 101 in FIG. 1A is a bookbinding cover, and portions 103 to 106 are portions to undergo crease processing. These portions are set on the assumption that crease processing is executed at four portions. A sheet 111 in FIG. 1B is also a bookbinding cover. The sheet 111 represents that, when crease processing at the portions 103 to 106 cannot be executed on the bookbinding cover by, for example, the function of the creaser serving as a post-processing apparatus, the job designation is changed to execute crease processing at portions 113 to 116.

At the portions 103 to 106 and 113 to 116 in FIGS. 1A and 1B, solid lines and broken lines indicate that surfaces to undergo crease processing are different. The broken lines of the portions 103 and 106 indicate that crease processing is performed from the back surface of the sheet. The solid lines of the portions 104 and 105 indicate that crease processing is performed from the front surface of the sheet. Reference numeral 102 denotes a section of the sheet 101 upon executing crease processing. 107 to 110 indicate that crease processing was performed on the sheet 101. The creasing die 355 was pressed from directions indicated by arrows.

In step S701, the CPU 402 checks whether a plurality of times of crease processing (at a plurality of portions) is set in a received print job. If a plurality of times of crease processing is not set (NO in step S701), the CPU 402 processes the received job in step S702. The CPU then ends this processing sequence.

If a plurality of times of crease processing is set (YES in step S701), the CPU 402 checks the setting of crease processing in the received job in step S703. In the setting check, it is checked whether the set crease processing includes a setting of performing crease processing from the two, front and back surfaces of a sheet. Therefore, crease processing determination according to this embodiment is performed. If the set crease processing is designated for only one surface of a sheet (NO in step S703), the process shifts to step S702. If crease processing is designated for the two surfaces of a sheet (YES in step S703), the process shifts to step S704.

In step S704, the CPU 402 checks whether post-processing apparatuses currently connected to the printing system include an apparatus capable of performing crease processing on the two surfaces of one sheet by one feeding. Here, one feeding represents that crease processing can be executed on the two (front and back) surfaces without the mediacy of manual work of a user until a sheet fed from the feeding deck 306 or 307 or the like is discharged to the discharge tray. The function determination regarding a post-processing apparatus is performed by obtaining information about a connected post-processing apparatus from the post-processing apparatus or the like and using the obtained information. If crease processing can be executed on the two surfaces by one feeding (NO in step S704), the process shifts to step S702.

If crease processing cannot be executed on the two surfaces by one feeding (YES in step S704), the CPU 402 checks in step S705 whether a sheet is designated in the job. If a sheet is designated (YES in step S705), the CPU 402 obtains, in step S706, information about the sheet designated in the job from a database that stores sheet information. Although this embodiment will give an explanation based on the grammage as an example of sheet information, attribute information such as the paper type (for example, thick paper or thin paper) or the direction of the orientation may be used. As another attribute, sheet information about crease processing may be obtained. After that, the process shifts to step S708.

If no sheet is designated in the job (NO in step S705), the CPU 402 specifies, in step S707 from information about sheets stored in current feeding trays, a feeding tray matching output information designated in the job. For example, when information designated in the job is only "A4" size information, the CPU 402 specifies a feeding tray storing "A4" sheets out of sheets designated in current feeding trays. The specified feeding tray serves as a feeding tray that is used when executing the job later. The CPU 402 obtains grammage information of the sheet from sheet information set for the feeding tray. The process then shifts to step S708.

In step S708, the CPU 402 compares the grammage information of the sheet obtained in step S706 or S707 with information serving as a determination criterion designated in advance. FIG. 8 shows criterion information used in this step. FIG. 8 shows a threshold for sheet information that is used to, when the fold setting of a sheet is the mountain fold (FIG. 6B), determine whether the setting can be changed to the valley fold (FIG. 6D). The determination is made based on whether the attribute information of the sheet is equal to or larger than the threshold. In this embodiment, when the grammage of a sheet is smaller than 150 gsm, the valley fold is "OK", and when it is equal to or larger than 150 gsm, the valley fold is "NG". These values are items that depend on the impression of the user who has confirmed a product having undergone crease processing. Thus, the operation screen 505 may display a setting change window capable of changing the threshold of the grammage, and allow the user to change the threshold. When another attribute is used as the determination criterion for permitting a change to the valley fold, a correspondence table as shown in FIG. 8 is prepared for each attribute. Further, the CPU 402 may be able to change (correct) a set value in consideration of the influence between respective attributes. For example, when grammage information and orientation information are used as determination criteria, the determination may be changed to permit the valley fold up to a grammage of smaller than 180 gsm as long as crease processing is executed in a direction complying with the orientation.

Figure 9:
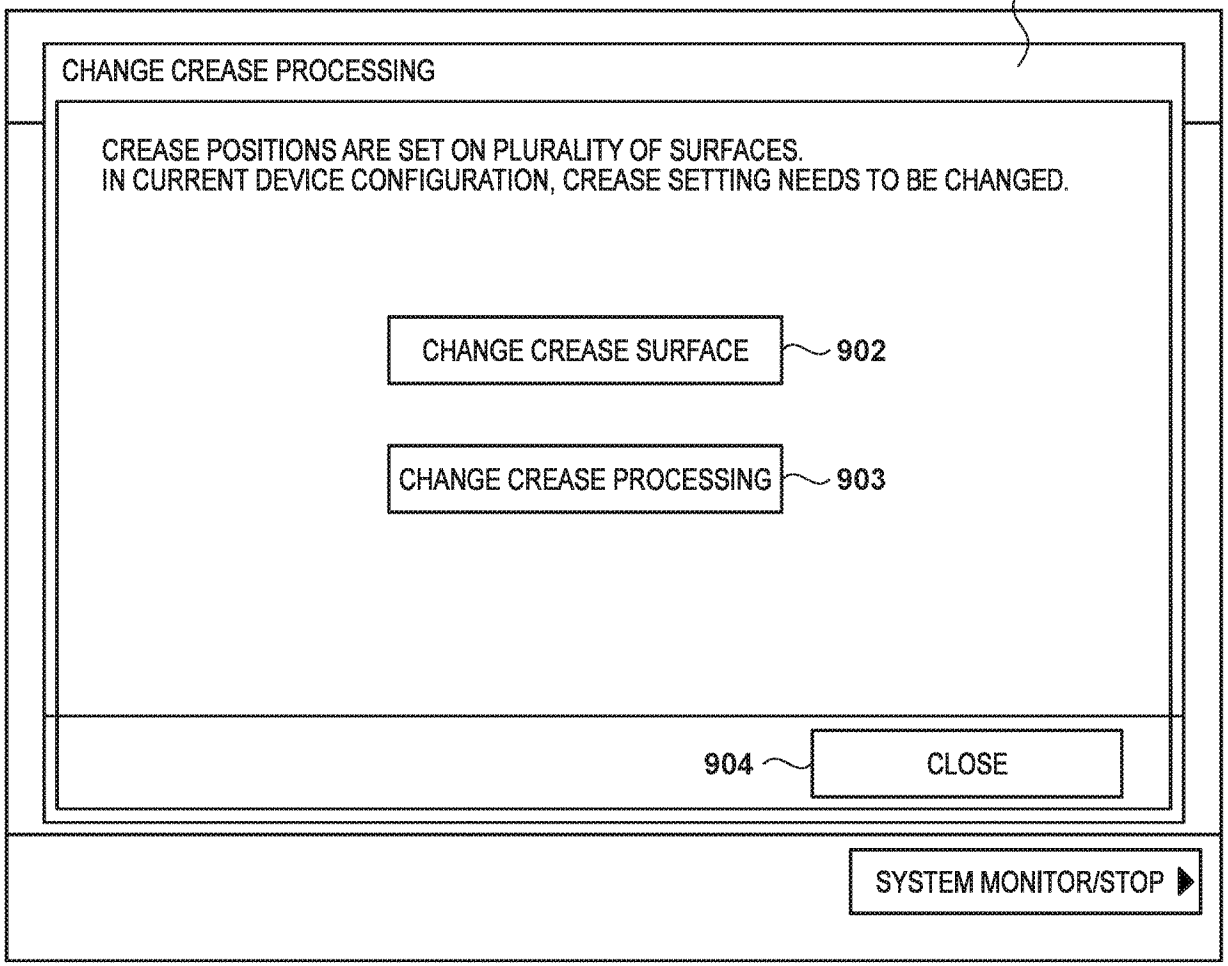
FIG. 9 is a view showing an example of a window for changing the setting of crease processing.

If the sheet allows a change to the valley fold (YES in step S708), the CPU 402 displays a window 901 for changing the setting of crease processing, as shown in FIG. 9, in order to determine in step S709 whether to perform crease processing by one time of processing. If the user presses a crease surface change button 902 (YES in step S709), the process shifts to step S710.

Figure 10:
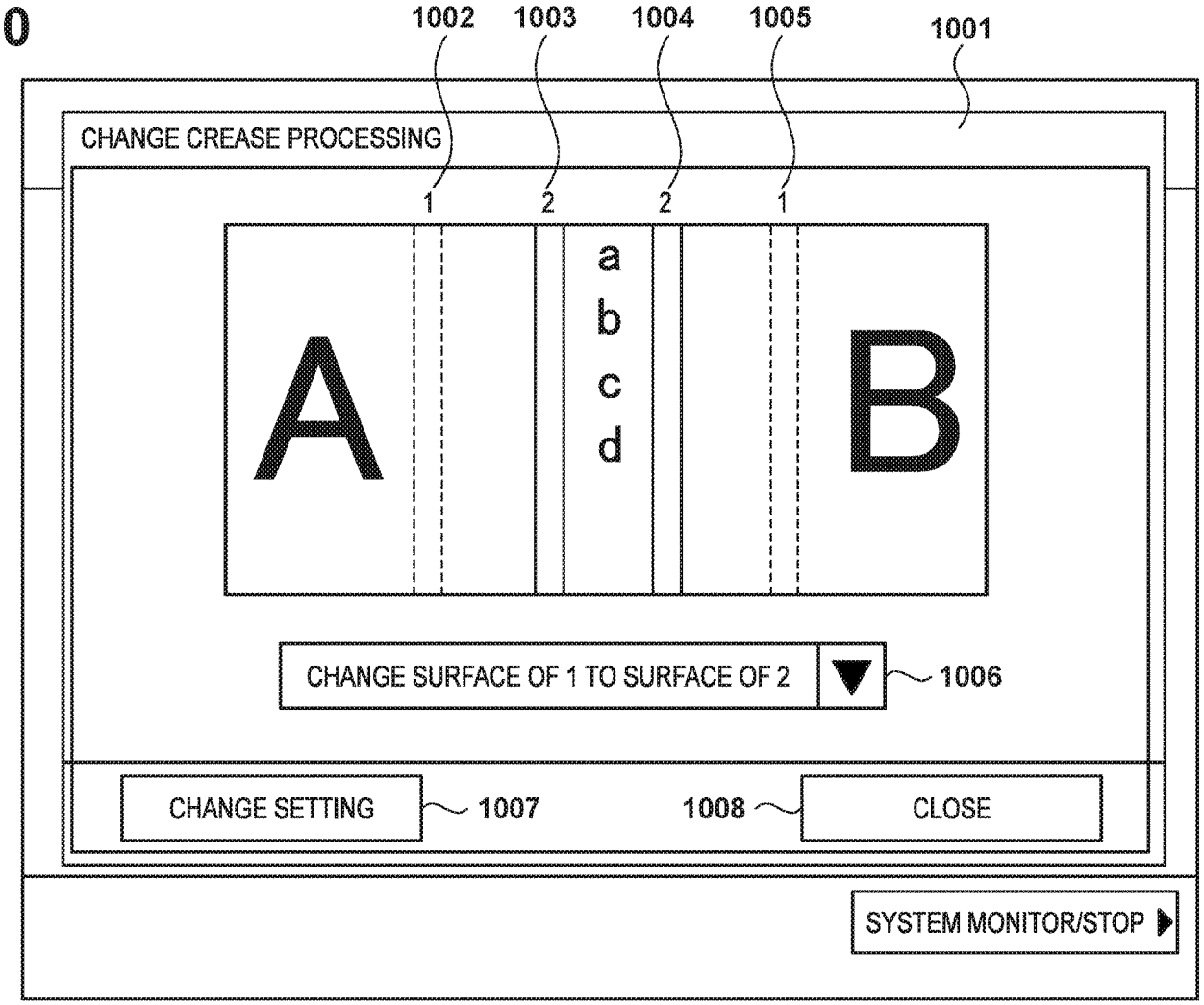
FIG. 10 is a view showing an example of a crease surface change window.

In step S710, the CPU 402 displays a window 1001 for changing a crease position, as shown in FIG. 10, in order to prompt the user to designate a portion to undergo the valley fold. Portions 1002 to 1005 shown in FIG. 10 are portions to undergo crease processing. This corresponds to the state of the sheet 101 in FIG. 1A. Portions indicated by broken lines with "1" at the portions 1002 and 1005 are portions that are creased from the back surface of a sheet. Portions indicated by solid lines with "2" at the portions 1003 and 1004 are portions that are creased from the front surface of a sheet. From a list box 1006, the user can select a change of a crease surface into either surface. For example, when the user selects "change surface of 1 to surface of 2", the portions with 1 are valley-folded. When the user selects "change surface of 2 to surface of 1", the portions with 2 are valley-folded. By this setting change, the output surface is changed. It is controlled to implement crease processing on a surface designated by the user by using a change of the printing surface and the sheet reversing mechanism so that crease processing can be executed on a surface designated at the time of crease processing. That is, crease processing is uniformed to one direction (front or back surface) of a sheet.

FIG. 1B is a view showing the sheet 111 when "change surface of 1 to surface of 2" is selected. All crease designation portions represented by the portions 113 to 116 are indicated by solid lines. This indicates that crease processing is performed on the front surface. Reference numeral 112 denotes a section of the sheet 111 upon actually performing crease processing. This indicates that crease processing was performed from the same direction at all portions 117 to 120. The user selects, from the list box 1006, either the front or back surface of a sheet on which crease processing is uniformly performed. Then, the user presses a setting change button 1007, reflecting the setting. If the user presses a close button 1008, a change of the setting is not reflected. Note that a printing result upon a change of the setting may be displayed as an image when the user changes the surface from the list box 1006. Also, a folding method may be explicitly displayed. When the user changes the setting and presses the setting change button 1007, the CPU 402 accepts the setting change of crease processing, and the process shifts to step S711.

In step S711, the CPU 402 executes crease processing on one surface set by the user for the print job. The CPU 402 then ends this processing sequence.

Figure 11:
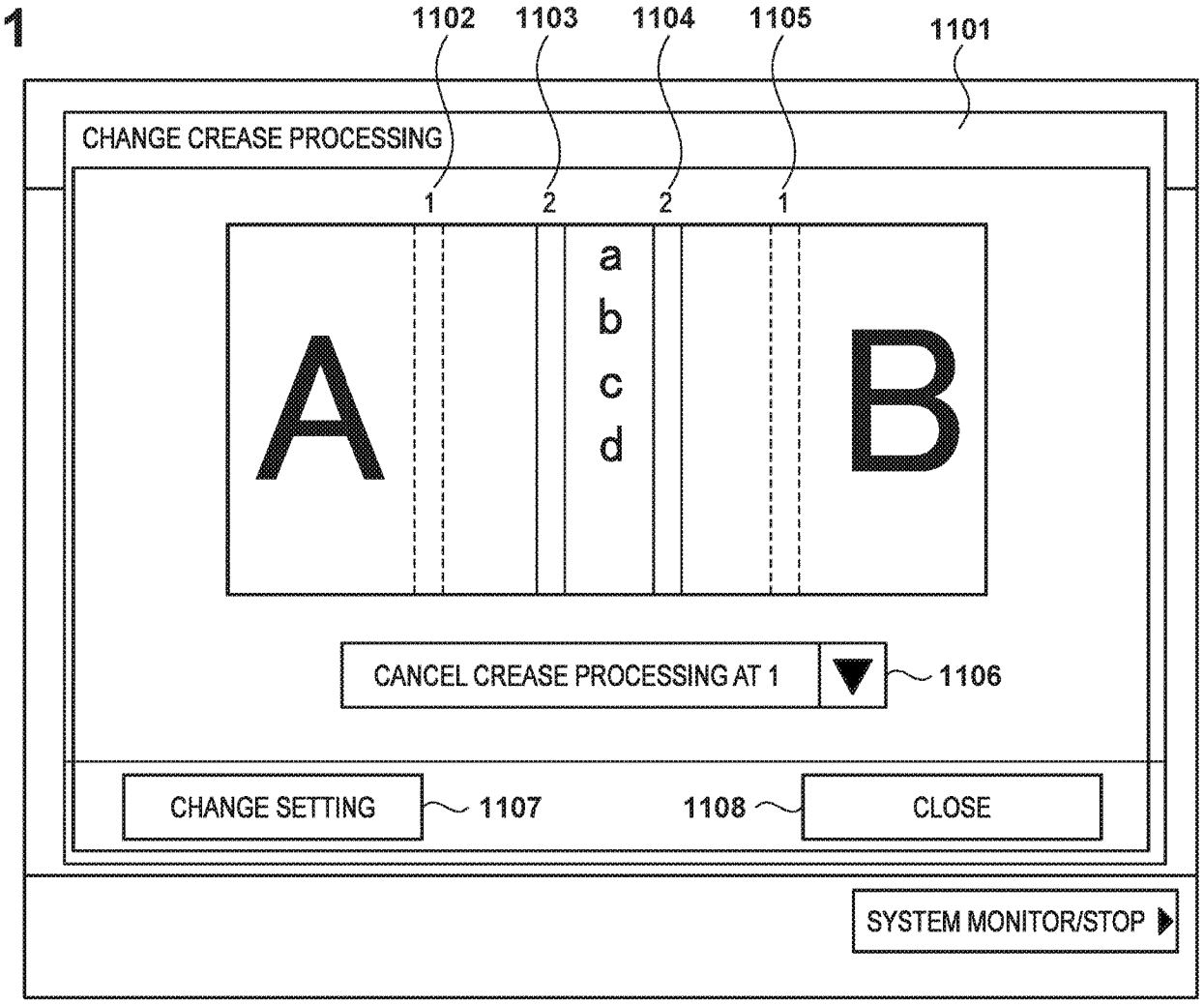
FIG. 11 is a view showing an example of a crease processing change window.

If the sheet inhibits a change to the valley fold (NO in step S708), the CPU 402 prompts the user to cancel crease processing on either surface of the sheet in step S712. FIG. 11 shows an example of a window 1101 for setting crease processing. Portions 1102 to 1105 are portions to undergo crease processing. This corresponds to the state of the sheet 101 in FIG. 1A. The arrangement of the window 1101 is the same as that of the window 1001 shown in FIG. 10. From a list box 1106, the user designates to cancel crease processing on either surface. At this time, the user can select to cancel crease processing on surface of 1 or cancel crease processing on surface of 2. When the user presses a setting change button 1107, the CPU 402 shifts the process to step S713. Note that the user manually feeds a sheet for crease processing that cannot be executed by one feeding, thereby performing crease processing on the two surfaces.

In step S713, the CPU 402 executes crease processing on the surface designated by the user for the print job. Thereafter, the CPU 402 ends the processing sequence. If the user presses a close button 1108 in step S712, the job may be canceled.

If the user presses a crease processing change button 903 on the window 901 of FIG. 9 (NO in step S709), the process shifts to step S712. If the user presses a close button 904, the job may be executed without changing crease processing, or the job may be ended.

[Crease Designation Processing (Change)]

Figure 12:
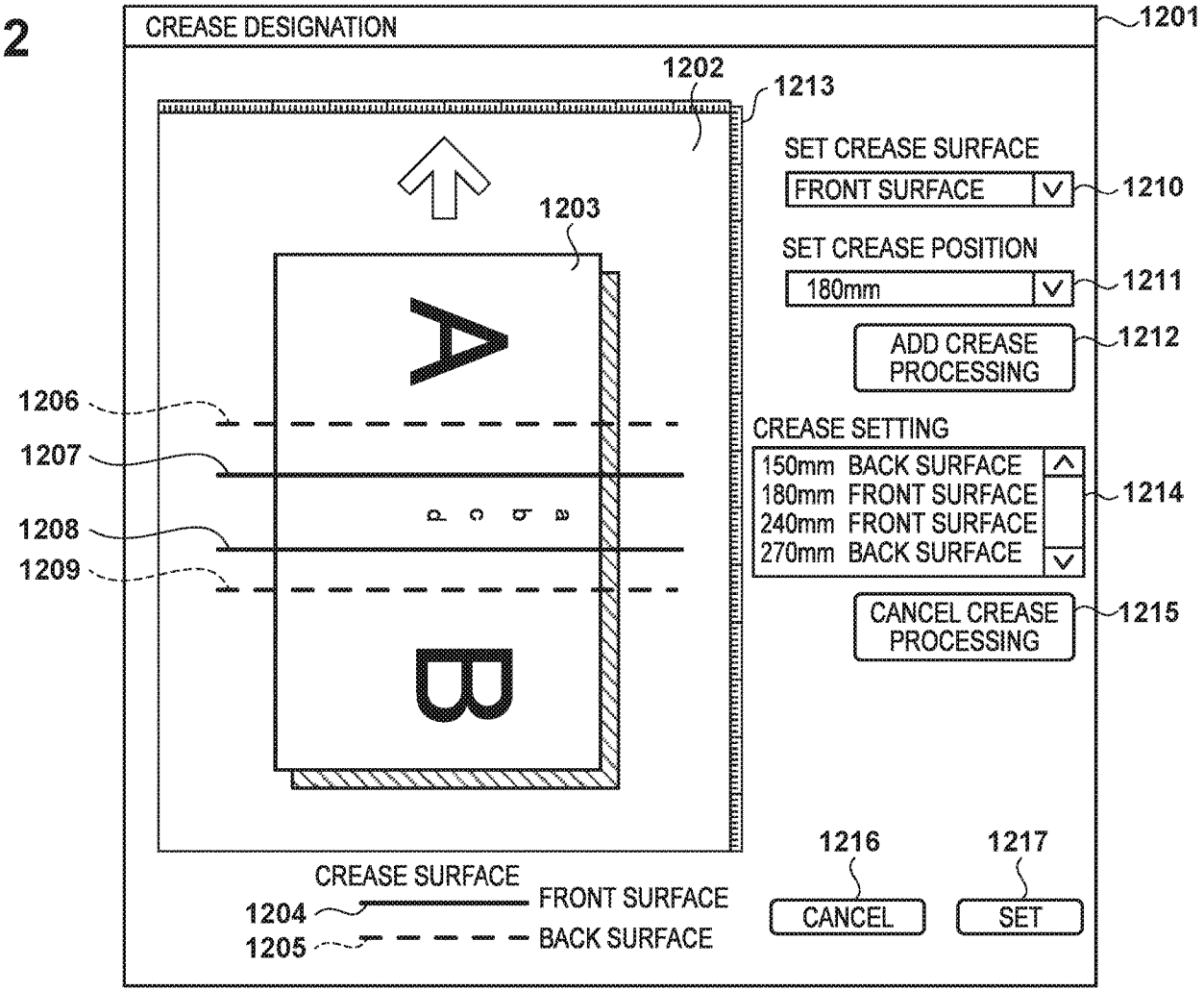
FIG. 12 is a view showing an example of a crease designation window.

A method of performing crease designation from the PC 205, the print server 204, or the printing system will be explained with reference to FIG. 12. Note that a crease designation window 1201 in FIG. 12 is generated and implemented by executing, by a CPU (not shown), a program loaded into the memory (not shown) of the PC 205 or print server 204. In the printing system, the crease designation window 1201 is implemented by executing, by the CPU 402, a program stored in the ROM 404 or the like. This embodiment will explain that the printing system executes this processing.

When the user designates the setting of crease processing in job setting, the CPU 402 displays the crease designation window 1201 shown in FIG. 12 on the operation screen 505. A region 1202 displays an image 1203 of a product. An arrow in the region indicates a sheet conveyance direction. Each of a solid line 1204 and a broken line 1205 indicates the front or back surface of a sheet as a crease surface. In this case, the solid line 1204 designates execution of crease processing on the front surface of a sheet. The broken line 1205 designates execution of crease processing on the back surface of a sheet. In this embodiment, it is designated to execute crease processing at four portions 1206 to 1209 in the image 1203. The portions 1206 and 1209 have the setting of crease processing from the back surface, and the portions 1207 and 1208 have the setting of crease processing from the front surface.

When newly designating crease processing, the user selects either the front or back surface from a crease surface setting list box 1210, and designates a crease position from a crease position designation list box 1211. After the settings in the list boxes 1210 and 1211, the user presses a crease processing addition button 1212. Then, the CPU 402 accepts new crease processing, and draws the added crease processing by a solid or broken line in the region 1202. Note that the crease position designation can be confirmed using a ruler 1213. Details of the already set crease processing are displayed in a list box 1214. If the user wants to cancel the designated crease processing, he selects crease processing displayed in the list box 1214 and presses a crease processing cancel button 1215. The CPU 402 cancels the selected crease processing in response to the pressing of the crease processing cancel button 1215, and cancels the drawing of the target crease processing drawn in the image 1203. Further, the CPU 402 deletes a corresponding display in the crease setting list box 1214.

When the user presses a cancel button 1216, settings made in the crease designation window 1201 are canceled. When the user presses a setting button 1217, settings made in the crease designation window 1201 are registered. When the printing system executes a job, crease designation set in the crease designation window 1201 is sent.

Note that crease processing in only one direction perpendicular to the sheet conveyance direction is shown. However, crease processing may be possible in a plurality of directions (for example, a direction parallel to the conveyance direction). When bookbinding cover designation is executed, this crease designation processing may be executed automatically.

[Crease Designation Processing (New Setting)]

Figure 13:
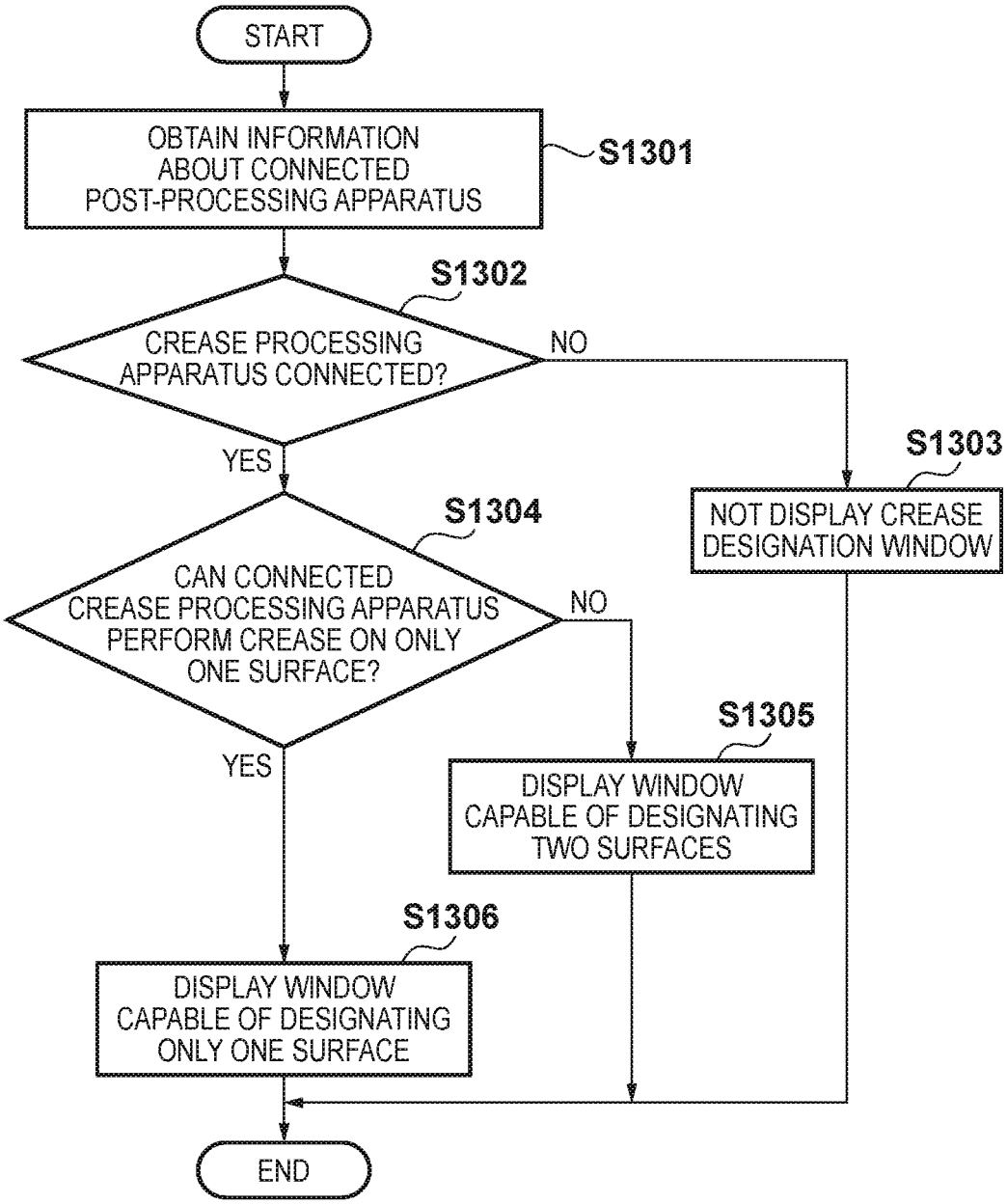
FIG. 13 is a flowchart showing designation window display processing.

A method of performing crease designation from the PC 205, the print server 204, or the printing system will be explained with reference to the flowchart of FIG. 13. Note that the flowchart in FIG. 13 is implemented by executing, by a CPU (not shown), a program loaded into the memory (not shown) of the PC 205 or print server 204. In the printing system, the flowchart in FIG. 13 is implemented by executing, by the CPU 402, a program stored in the ROM 404 or the like. This embodiment will explain that the printing system executes this processing.

Upon receiving an instruction from the user to display a crease processing setting window on the operation screen 505, the CPU 402 starts the processing. In step S1301, the CPU 402 obtains information about a connected post-processing apparatus. In step S1302, the CPU 402 determines, from the obtained post-processing apparatus information, whether a crease processing apparatus (creaser) is connected. If no crease processing apparatus is connected (NO in step S1302), the CPU 402 controls not to display the crease processing setting window (FIG. 12) in step S1303. The CPU 402 then ends this processing sequence.

If a crease processing apparatus is connected (YES in step S1302), the CPU 402 determines, in step S1304 based on function information represented by the crease processing apparatus information, whether crease processing can be executed on the two surfaces of one sheet by one feeding. If crease processing can be executed on the two surfaces by one feeding (NO in step S1304), the CPU 402 displays a crease designation window 1401 shown in FIG. 14 in step S1305, and controls the display so that crease processing on the two surfaces can be designated. The basic arrangement of the crease designation window 1401 is the same as that in FIG. 12. The CPU 402 then ends this processing sequence.

Figure 14:
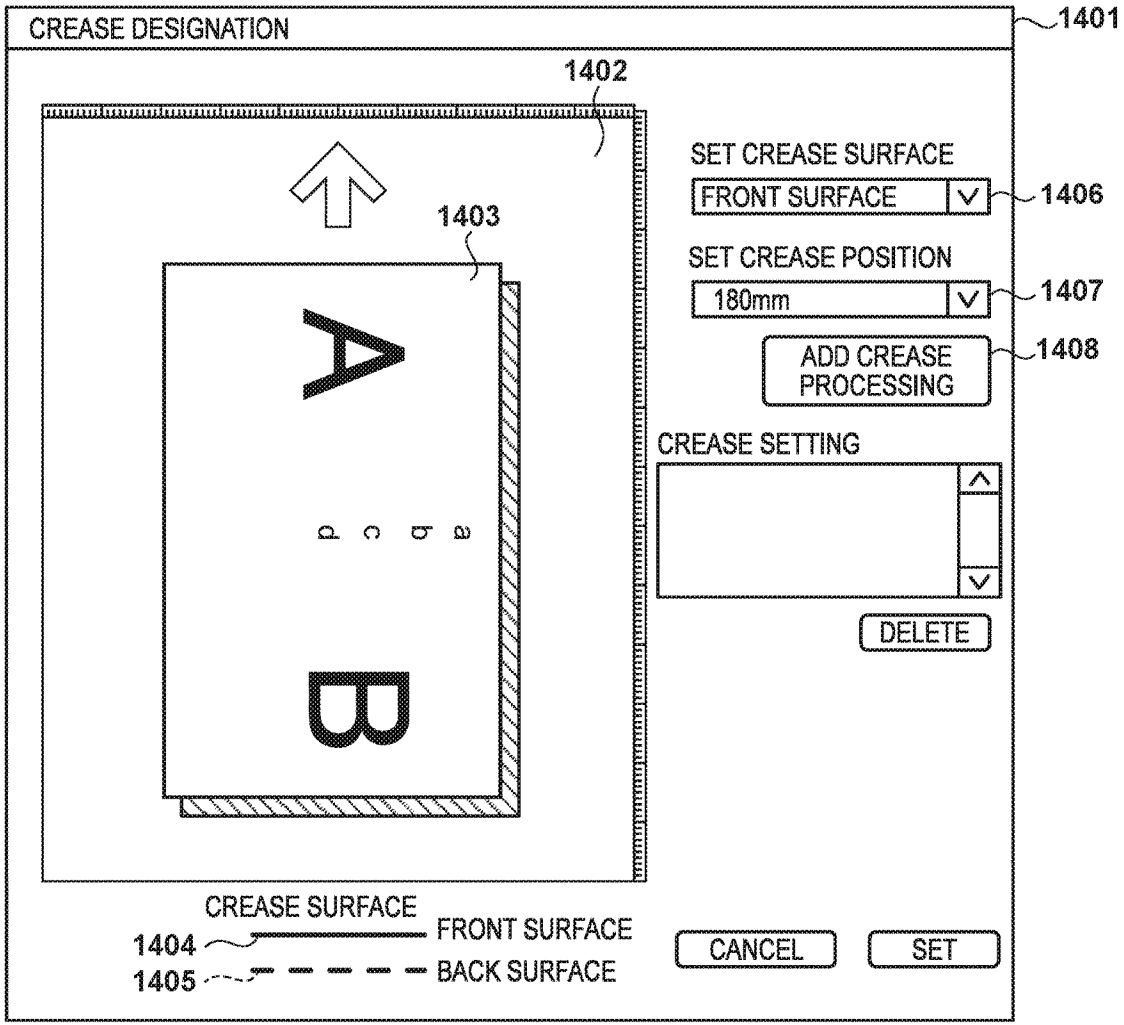
FIG. 14 is a view showing an example of a crease surface/position designation window.

If the connected crease processing apparatus cannot execute crease processing on the two surfaces by one feeding (YES in step S1304), the CPU 402 displays the crease designation window 1401 shown in FIG. 14 in step S1306. At this time, the CPU 402 controls the display so that crease processing on only one surface can be designated, unlike step S1305.

In a state in which even one setting of crease processing is not made in a crease surface designation list box 1406, the setting of crease processing can be added to the front and back surfaces. After a crease setting is added, it is subsequently controlled that a crease setting can be additionally selected for only the same surface as that of the already set crease processing.

Figure 15:
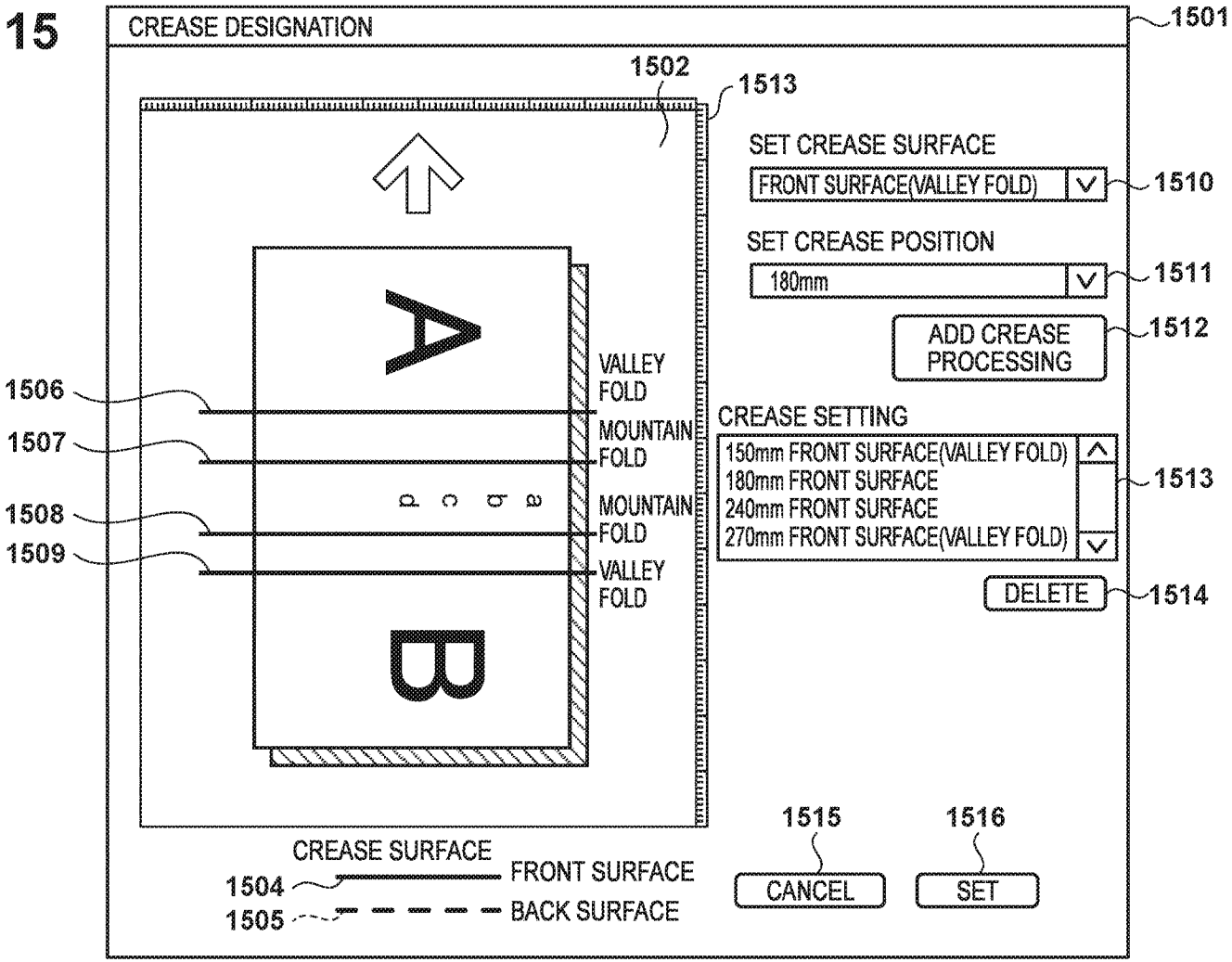
FIG. 15 is a view showing an example of a crease surface/position designation window.

A state in which a plurality of crease designations are set will be explained using a crease setting window 1501 in FIG. 15. The arrangement of the window is the same as those in FIGS. 12 and 14 already described above, and a description of repetitive portions will not be given. In FIG. 15, crease processing is designated at four portions 1506 to 1509. The portions 1506 and 1509 are indicated by solid lines, and this represents crease processing from the front surface. However, when actually performing folding, the portions 1506 and 1509 are valley-folded, so "valley fold" is displayed beside the solid lines indicating crease positions. The portions 1507 and 1508 are indicated by solid lines, and this represents crease processing from the front surface. When actually performing folding, the portions 1507 and 1508 are mountain-folded, so "mountain fold" is displayed beside the solid lines indicating crease positions.

When newly designating crease processing, the user selects either the front or back surface from a crease surface setting list box 1510, and designates a crease portion from a crease position designation list box 1511. In this case, an example is assumed, in which a folding surface designated first is "front surface". It is therefore controlled to display "front surface (mountain fold)" and "front surface (valley fold)" in a list box 1513. When a folding surface designated first is "back surface", "back surface (mountain fold)" and "back surface (valley fold)" are displayed in the list box 1513. After the crease surface setting and the settings of the list boxes 1510 and 1511 in the crease position designation, the user presses a crease processing addition button 1512. Then, the CPU 402 accepts new crease processing. The CPU 402 draws the added crease processing in the region 1502.

According to the present invention, the setting of crease processing is controlled in accordance with a function capable of crease processing on a sheet by one feeding in the post-processing apparatus of the printing system. As a result, the procedures and time until a printed material is obtained can be reduced, and the work load on the user for printing can be reduced.

Note that a folding direction instruction statement may be printed so that the user can easily recognize the instruction of a folding direction when a job is executed. It may also be controlled to automatically apply crease designation processing according to the present invention to a folding position when a setting implementable on one surface (front surface) is made automatically in advance and a folding position is designated upon executing designation of a bookbinding cover at the time of generating a print job.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-034708, filed Feb. 25, 2014, which is hereby incorporated by reference herein in its entirety.

What is claimed is:

1. A printing system comprising:

an image forming unit configured to form an image on a sheet;

a creasing unit configured to crease the sheet conveyed from the image forming unit and comprising a creasing die which is selectively attachable, wherein the creasing unit creases the sheet by pressing the creasing die against the sheet;

a setting unit configured to set a plurality of creasing positions on the sheet to be creased by the creasing unit, the setting unit being configured to independently set, for each creasing position, whether to crease from a front surface on the sheet or crease from a back surface on the sheet; and a control unit configured to:

(i) check a setting of the plurality of creasing positions to determine whether creasing from both surfaces for the sheet is to be performed, (ii) obtain information of the creasing unit to determine whether the creasing unit is able to crease from both surfaces of one sheet, and (iii) if it is determined that creasing to both surfaces is to be performed and it is determined that the creasing unit is not able to crease from both surfaces of one sheet, display a warning screen on a display unit to prompt a user to change the setting of the plurality of creasing positions.

2. The printing system according to claim 1, wherein the creasing unit comprises a first conveyance path for conveying, to a finisher, the sheet conveyed from the image forming apparatus, without performing creasing, and a second conveyance path which branches from the first conveyance path and is a path for creasing the sheet conveyed from the image forming unit and conveying the sheet to the finisher.

3. The printing system according to claim 1, wherein the creasing unit creases the sheet in a direction orthogonal to the conveyance direction of the sheet.

4. The printing system according to claim 1, wherein the warning screen displays a change button for changing a creasing surface.

* * * * *